United States Patent [19]

Kiyokawa et al.

[11] 4,055,526

[45] Oct. 25, 1977

[54] PLANAR HEATING ELEMENT AND PRODUCTION THEREOF

[76] Inventors: Shin Kiyokawa; Shokichi Sakaguchi; Toru Takeuchi, all of 139, Kamihikona, Misato, Saitama, Japan

[21] Appl. No.: 562,046

[22] Filed: Mar. 26, 1975

[30] Foreign Application Priority Data

Mar. 29, 1974 Japan ..... 49-35373
Mar. 29, 1974 Japan ..... 49-35374

[51] Int. Cl.[2] ..... H05B 3/18

[52] U.S. Cl. ..... 264/22; 219/528; 219/531; 219/548; 219/549; 252/511; 264/25; 264/104; 264/105; 264/174; 264/DIG. 46

[58] Field of Search ..... 264/104, 105, 174, 25, 264/DIG. 46; 219/528, 531, 548, 549; 252/511

[56] References Cited

U.S. PATENT DOCUMENTS

| | | | |
|---|---|---|---|
| 2,291,670 | 8/1942 | Wiley et al. | 264/174 |
| 2,636,923 | 4/1953 | Perzel | 264/174 |
| 3,387,065 | 6/1968 | Derbyshire et al. | 264/174 |
| 3,412,358 | 11/1968 | Hummel et al. | 219/528 |
| 3,535,494 | 10/1970 | Armbruster | 219/528 |
| 3,728,424 | 4/1973 | Bauer | 264/174 |
| 3,823,217 | 7/1974 | Kampe | 264/105 |
| 3,846,223 | 11/1974 | Lederman et al. | 264/105 |

*Primary Examiner*—Jeffery R. Thurlow
*Attorney, Agent, or Firm*—Armstrong, Nikaido & Marmelstein

[57] ABSTRACT

The present invention is related to a method for producing a planar heating element. The method comprises melt-admixing an insulating thermoplastic resin with an electrically conductive powder. The mixture is then extruded, and the extruded body is rapidly cooled.

8 Claims, 9 Drawing Figures

PLANAR HEATING ELEMENT AND PRODUCTION THEREOF

BACKGROUND OF THE INVENTION

This invention relates to planar heating element comprising thermoplastic resin as a supporter and electrically conductive powder unevenly distributed in the neighborhood of (and on) the surface thereof. Heretobefore, planar heating elements have been used in various fields in order to heat or maintain constant temperatures over wide areas or for example, as heaters for melting snow, preventing freezing of roads or water conduits, maintaining or elevating the temperature of chemical apparatus, or cultivating.

Known planar heating elements to be applied in above various fields are as follows.

A. a heating element produced by laminating corrosion-proof aluminum foil or copper foil of 2 - 100 $\mu$ in the thickness onto an insulating heat proof plastic film, then etching the metal foil.

B. a heating element produced by adhering carbon powder onto a plate made of glass fiber, then laminating an elastomeric or plastic insulating cover.

C. a heating element produced by weaving carbon fiber.

D. a heating element produced by molding elastomer or plastic resin and carbon powder.

Although (A) can give an extremely thin heater having high power in spite of small area, it as many shortcomings such as weakness to bending and the difficulty in large capacity heating. (B) has the such shortcomings as low flexibility, great changes in resistance as a result of bending, difficulty in maintaining constant resistance and weakness to pressure. (C) has the same shortcomings as (B) and carbon fiber is quite expensive. (D) is a good processibility but has a critical shortcoming. In (D), a great amount of carbon powder is necessary in order to obtain a resistance value suitable for operation under low voltage such as 100 V or less. In some case, 50 - 60% by weight of carbon powder must be added. However, in a case of adding such a great amount of carbon powder to thermoplastic resin, it is quite difficult to mold them and the obtained heater has less flexibility, accordingly the use is quite restricted.

Planar heating elements of the above mentioned (A) - (D) types have many shortcomings and can be applied only for use of small size and small capacity. In addition, known planar heating element have a characteristic that when using them at an elevated temperature or long time, their resistance values drop in accordance with the negative resistance of carbon itself. Under an elevated temperature, higher electric current is necessary, so, finally the heaters are destroyed by over heat. Accordingly, the known planar heating elements require various means for temperature detection and controlling.

SUMMARY OF THE INVENTION

It is an object of this invention to provide a novel planar heating element having stable and excellent properties which is suitable for mass production. A further object is to provide a novel planar heating element having a self-controlling function, that is, a characteristic that when the heating element has lower temperature, higher electric current is drawn, and when the temperature is higher, lower electric current is drawn correspondingly.

Another object is to provide a novel planar heating element having desirable flexibility, strength, toughness, pressure resistance and humidity resistance properties.

Another object is to provide a novel planar heating element in which lead wires contact tightly with an electric conductive layer of the heating element and outer electric circuits, and the lead wires are inserted in the center of the section of the heating element.

Another object is to provide a novel planar heating element suitable for 15 various fields such as industrial, public works, constructions, agricultures, livestock farmings.

In order to achieve above mentioned object, this invention is characterized in that electric conductive powder is added into an insulating thermoplastic resin to form a melt-blend and extruding the melted thermoplastic resin composition into the shape of sheet such as plate, cylinder and the like, then cooling the obtained molded body rapidly to produce planar heating element in which the electric conductive powder is unevenly distributed on the surface and in the neighborhood of the surface to constitute a partial electric conductive layer. Further, this invention is characterized that in the above mentioned molding process, the molded body is stretched or drafted to bring about inner stress in the molecules of the body and a temperature to resistance characteristic of the obtained planar heating element is controlled by utilizing the inner stress.

DETAILED DESCRIPTION OF PREFERRED EMBODIMENTS

Figure 1:
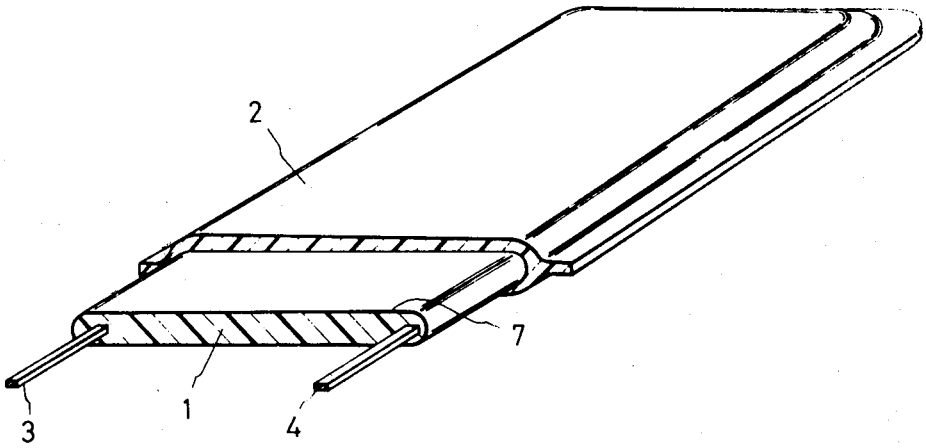
FIG. 1 is a schematic drawing of a part of the planar heater.

The planar heating element of this invention is produced by the process of melt-admixing the insulating thermoplastic resin with an electrically conductive powder and extruding the melting thermoplastic resin with the dispersed electric conductive powder therein, then cooling the molded thermoplastic resin composition rapidly while the molded thermoplastic resin is still in the molten state or in the softening state, and then, preferably, stretching or drafting the molded thermoplastic resin.

In general, when forming a planar heating element by using carbon powder or other electrically conductive powder as an ingredient of electrically conductive layer of the planar heating element an extremely great amount of the powder has been required.

In the known techniques at least 50 – 60% by weight of carbon powder has to be added in order to function as heater element. As a result of using such a great amount of carbon power, it is quite difficult to mold them and the mechanical strength of the obtained element is quite inferior.

According to this invention, the amount of the electric conductive powder such as carbon powder is small in order to grant to the planar heating element simultaneously good moldability, electric conductivity, flexibility and pressure resistance property. When a small amount, for example, 20% of carbon powder is added and dispersed equally into the molded body as in known planar heating elements, electric resistance of the obtained molded body is extremely high, so it can not be used as a planar heating element at all.

According to this invention, the above mentioned problem is solved. That is, according to this invention, carbon powder is unevenly distributed in a specific part of the molded body and other parts of the molded body do not act as a resistor of the heating element, therefore a large amount of carbon powder is not necessary at all. The planar heating element of this invention is essentially different from a two layer heating element constructed by carbon layer bonded onto insulating layer with adhesive agent.

The two layer element produced by bonding two layers tends to easily peel off by pressure or bending and to change gradually the characteristic of the electric conductive layer by action of the adhesive agent involved therein. On the other hand the heating element of this invention is essentially constructed in a body, and shows good characteristics even if under pressure 200 $Kg/cm^2$ or more. The heating element of this invention is produced from thermoplastic resin as a supporter and a small amount of carbon powder or other electric conductive fine powder added therein.

Therefore, the moldability is not essentially different from those in general thermoplastic resins. The supporter is insulating thermoplastic resin which preferably has properties such as good blend ability with electrically conductive powder, good molding ability, stretching or drafting ability during heating, maintaining ability of contractile energy generated in the molecule by stretching or drafting and good thermal stability.

Typical examples of the insulating thermoplastic resin are polyethylene, polypropylene, polyvinylchloride, copolymer of ethlene and vinyl acetate and the mixture thereof.

Carbon powder or other electrically conductive powder which is unevenly distributed in the neighborhood of the surface is produced by rapid cooling of the molding body immediately after melt extrusion, that is, while the dispersed powder can move therein.

That fact of unevenly distributing electric conductive powder by rapid cooling has a quite important meaning in this invention.

The methods of cooling include (A) immersing the molded body in cooling water, (B) contacting the molded body with a cooling roll by pressing it between a pair of cooling rolls, (C) spraying cooling air or cooling liquid to the molded body and others. The amount of electrically conductive powder added to the thermoplastic resin is different according to the thermoplastic resin to be used and the desired characteristics, but it is usually less than 40% by weight of the thermoplastic resin.

Figure 2:
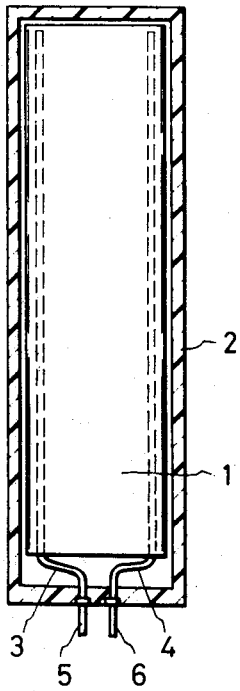
FIG. 2 is a partial sectional view of the planar heater.
Figure 3:
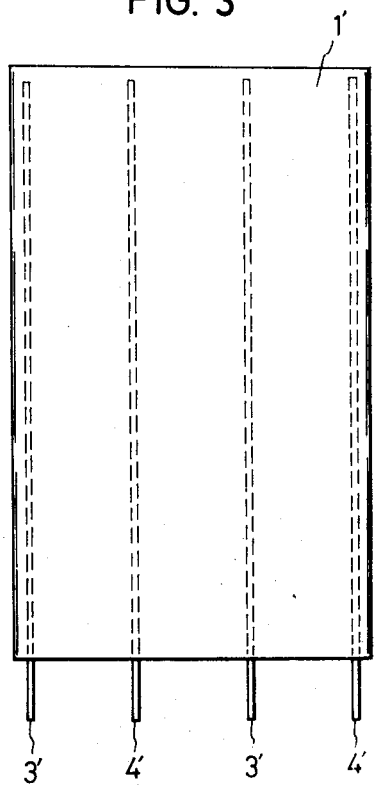
FIG. 3 is a sectional view of another planar heating element.

As to a structure of the planar heater as shown in FIG. 1 and FIG. 2, the surface of the heating element 1 is covered with the insulating cover 2, and the terminals 5, 6 and the lead wires 3, 4 are connected togetherwith. On the surface of the heating element between the lead wires 5, 6, carbon powder or other electrically conductive fine powder is unevenly distributed to form the electric conductive layer 7 and between the lead wires 3, 4 there is a specific value of resistance. Preferable heating element 1 is in the shape of a belt having lead wires 3, 4 set in parallel with the belt. In FIG. 3, the heating element 1 is connected with a number of the lead wires 3', 4', 3'', 4'' . . . in order to enlarge the heating area.

Figure 4:
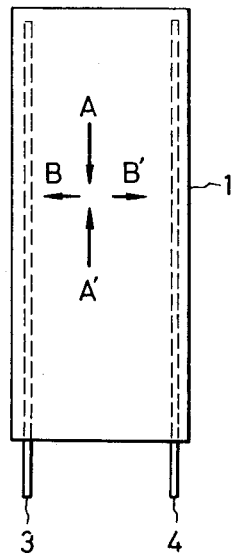
FIG. 4 is a sectional view of the planar heating element to explain the self-controlling function of the planar heating element.

The shape of the heating element is selected from such planar shapes as a plate, cylinder, triangular tape, and the like according to the desired use. The self temperature controlling function of the planar heating element is explained in FIG. 4.

When an electric current flows between the lead wires 3 and 4, the electric current path is through the electrically conductive layer 5 to generate a joule heat. The joule heat gradually elevates the temperature of heating element 1 and the heating element tends to shrink in the direction of A, A' of FIG. 4, or in the transverse direction of the heating element, by the action of the contractile energy stored in the molecule during the stretching or drafting step in accordance with elevating of the temperature. When the contractile stress is generated in the heating element, the direction crossing the contractile stress, that is the direction of B, B', is slightly extended.

As a result, the distance between the lead wires 3 and 4 is increased, and accordingly the resistance value of the electrically conductive layer is raised, and electric current value is decreased in inverse proportion to the resistance value.

Such a fact is brought about by stretching or drafting action in the molding process, and the characteristic depends upon the stretching magnification ratio. Therefore the stretching or drafting condition is quite important in producing the heating element. The features of this invention are as follows.

In the heating element of this invention electrically conductive powder such as carbon powder is unevenly distributed in one part of the heating element, so, a smaller amount of the powder imparts suitable electric resistance to the heating element. The main part of the heating element comprises a thermoplastic resin layer having a quite smaller content of the powder, so, the heating element has mechanical properties almost equal to a molded article made from thermoplastic resin without the powder.

The heating element of this invention has quite excellent heating efficiency, because the heating element has the characteristic that increasing of resistance value depends on elevating of the temperature. When a temperature of the heating element is elevated over the limited value, the resistance value is extremely increased and automatically the electric current is decreased.

The heating element of this invention has excellent characteristics as well as high flexibility, for example, it can sustain a pressure over 200 $kg/cm^2$.

The heating element of this invention can be produced quite easily and quite economically. The heating element of this invention can show various characteristics by controlling the amount of electrically conductive powder, the kind of the thermoplastic resin, the distance between the lead wires, cooling velocity and the other conditions. In the planar heating element of this invention, various ingredients such as a heat stabilizing agent, antioxidation agent, blocking agent and others can be included as in known molded articles. In addition, it is quite efficient to apply high energy radiation to the molded body in order to improve the mechanical properties thereof, such as thermal stability and toughness. Any form of high energy ionizing radiation is suitable, including particulate or X-ray radiation, such as, high speed electrons, protons, alphaparticles, a beta rays.

Typical sources of ionizing radiation are electron accelerators of the Van de Graaff type, cobalt 60 or the like. The following examples are illustrative of the practice of this invention.

EXAMPLE 1

The following were admixed: 20% by weight of polyethylene, 50% 25 by weight of copolymer of ethylene and vinyl acetate (EVA), 20% by weight of polyvinylchloride and 20% by weight of carbon powder (to the total weight of the thermoplastic resins).

Figure 5:
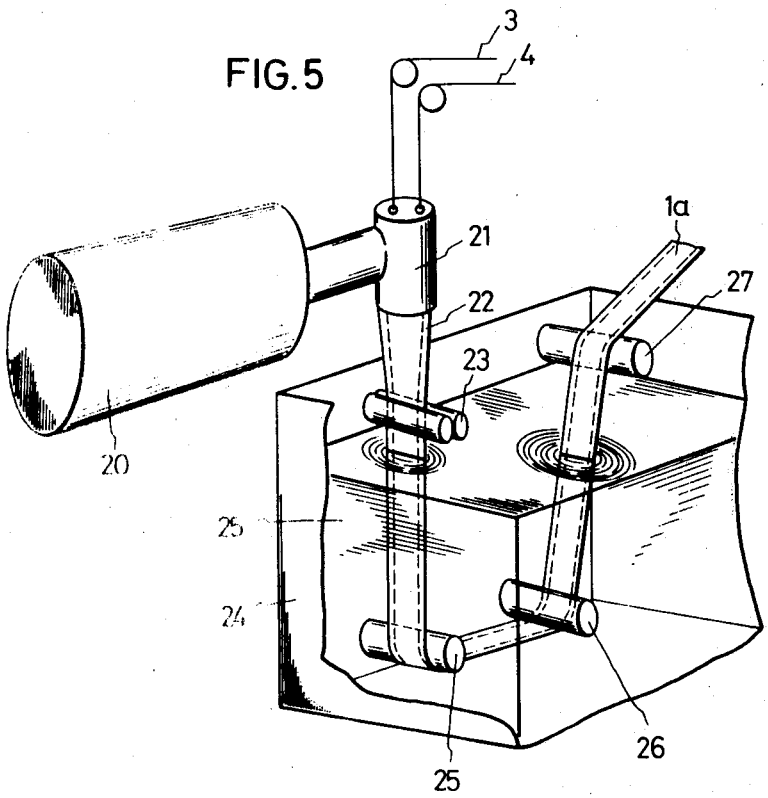
FIG. 5 is a schematic view to explain the molding process of the planar heating element.

The composition was melted and admixed uniformly at 180° C, and the melt extruded from the die 21 equipped at edge of the extruder 20 in FIG. 5 at a velocity of 2.5 m/min. to produce the cylindrical body 22. The two lead wires 3, 4 were supplied into the cylindrical body, then the cylindrical body 22 was pressed between te nipping rolls 23, the produced planar body was cooled rapidly by immersing into quenching liquid 25 of 18° C in the water vessel 24. The produced planar heating element 1*a* was rolled up through guide rollers 25, 26 and 27.

The produced planar heating element was 200 mm width and 1.3 mm thickness. The characteristic of the planar heating element is illustrated as curve B in FIG. 6.

A current was applied to the planar heating element under pressure of 180 kg/cm$^2$, but a change in the resistance to temperature characteristic was not influenced by pressure at all.

Although the surface part of the heating element showed a resistance value of 240 Ω/m, the inner layer (after cutting the surface layer) showed a resistance value nearly equal to an insulating layer. Such a fact shows that carbon powder is unevenly distributed in the neighborhood of the surface of the element. When the surface of the heating element was rubbed with a cloth, a change in resistance value was not seen, accordingly, it is clear that the carbon powder was firmly combined with the thermoplastic resin. Incidentally, the molded body produced in the above Example was applied with ionizing radiation of 10 M rad a Van de Graaff accelerator at 60° C. The produced body has an excellent thermal stability.

Example 2

Polyethylene involving 25% by weight of carbon powder was melt-admixed and supplied to a extruder and melt-extruded through a T type die having a flat slit to produce sheet body and the produced sheet body was cooled rapidly by showering water of 20° C and rolled up to produce a planar heating element of 1.0 mm thickness and 250 mm width. The planar heating element had the characteristic illustrated by the curve A in FIG. 6. Carbon powder was unevenly distributed at the surface part.

EXAMPLE 3

Figure 6:
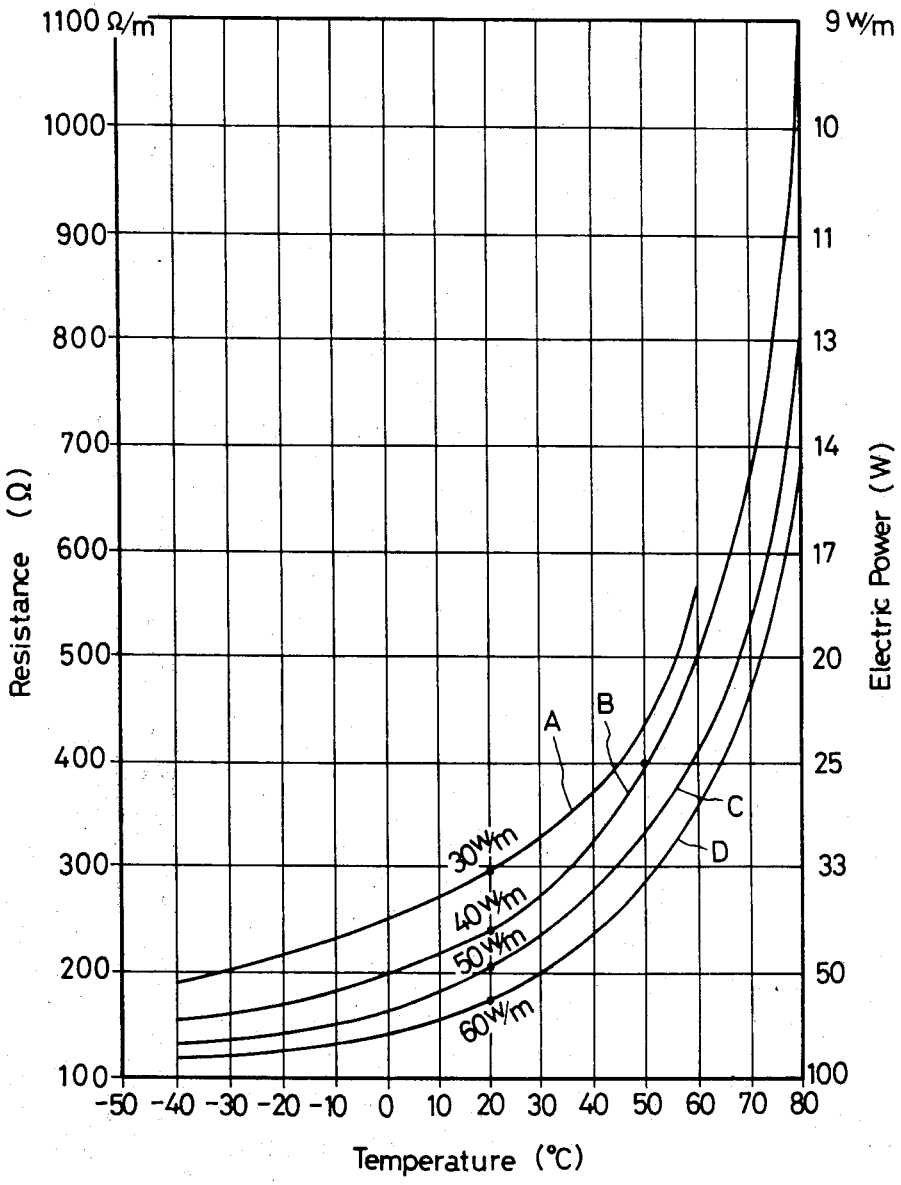
FIG. 6 is a diagram of the characteristics of the planar heating element.

The planar heating element of 200 mm width was produced in accordance with the same condition as in Example 1 other than the rolled up velocity of 2.5 m/min. The characteristic of the produced element was illustrated as the curves C, D, in FIG. 6. In FIG. 6, the vertical axis shows surface temperature (°C) of the heating element and the longitudinal axis shows resistance value (Ω/m) and spent voltage (W/m). The curve A shows spent voltage of 30 W/m at 20° C, and resistance value is 300 Ω/m at that time. The curve B shows spent voltage of 40 W/m at 20° C, and resistance value is about 240 Ω/m. The curve C shows spent voltage of 50 W/m at 20° C, and resistance value is about 210 Ω/m at that time. The curve D shows spent voltage of 60 W/m at 20° C, and resistance value is about 170 Ω/m at that time.

Figure 7:
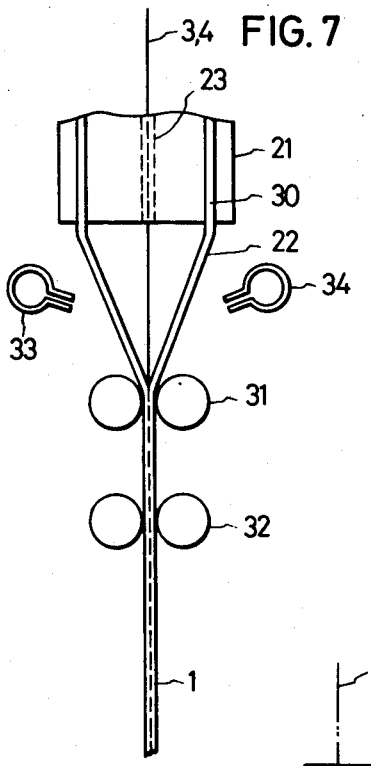
FIG. 7 is a side sectional view explaining a main portion of the molding process of the planar heating element.

The above mentioned results show the possibility of automatic temperature control. According to this invention, stretching or drafting in the molten or softening state is important and is conducted as follows. In FIG. 7, a cylindrically molded body is formed and pressed with nipping rolls to make a sheet. The cylindrical die 21 is equipped with slit and the hole 23 for guiding the lead wires 3, 4 and the molded body 22 is extruded through the die 21, immediately pressed between the nipping rolls 31, 32 to make a sheet as illustrated in FIG. 1.

The die 21 is equipped with the nozzles 33, 34 from which cooling liquid or cooling gas is sprayed to cool the surface of the molded body 22 immediately before pressing with the nipping roll 31. The nipping rolls 31, 32 have if necessary, cooling liquid thereof.

The rotation velocity of the nipping rolls 31, 32 can be changed. Accordingly, it is possible to stretch or draft by controlling the rotation velocity of the nipping rolls at a desired magnification ratio.

Figure 8:
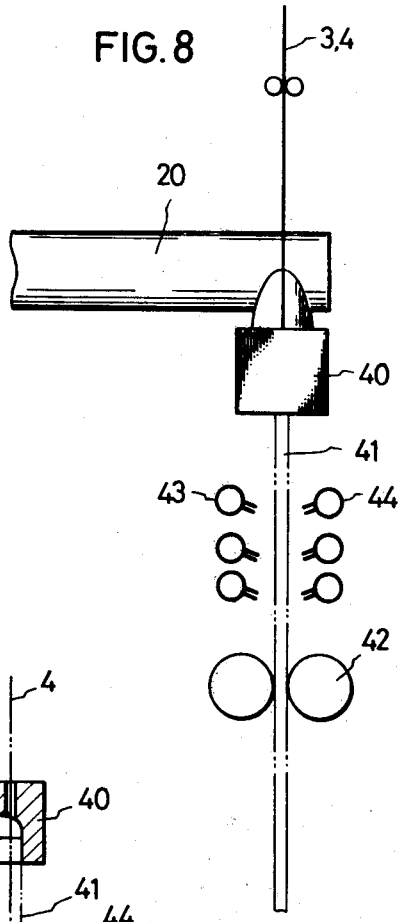
FIG. 8 is a side view explaining a main portion of the molding process of the planar heating element.
Figure 9:
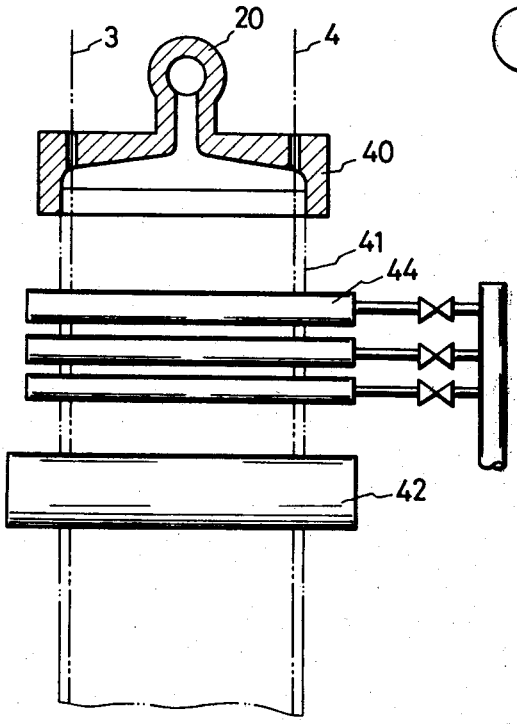
FIG. 9 is a front view explaining the process in FIG. 8.

FIG. 8 and FIG. 9 show apparatus for producing heating elements using a T die. In such an apparatus, the T die is equipped with the edge of the extruder 20 and the lead wires 3, 4 are supplied from shoulder part of the T die 40. A molded body extruded from the T die is imparted with a desired draft by nipping roll 42 and cooled rapidly by cooling liquid or cooling gas sprayed from the nozzles 43, 44. The produced planar heating element is cut to a desired length according to desired use and covered with the cover 2 as shown in FIG. 1.

EXAMPLE 4

To the mixture of 20% by weight of polyethylene, 50% by weight of copolymer of ethylene and vinyl acetate, and 20% by weight of polyvinylchloride 20% by weight (to the total weight of the thermoplastic resin) of carbon powder was added and mixed uniformly, and melted at 180° C and the melted composition was extruded at 2.5 m/min. by using the apparatus shown in FIG. 7 to produce the molded body 22. Into the edges of the produced molded body in the shape of cylinder the lead wires 3, 4 were supplied and pressed with the nipping roll 31 to make a sheet. The surface of the molded body 22 was cooled rapidly by showering cooling water of 18° C from the nozzles 33, 34. The produced planar heating element was 220 mm width and 1.3 mm thickness in the heating portion.

The characteristics of the planar heating element were changed according to the change of rotation velocity of the nipping rolls 31, 32. When the rotation velocity of the nipping rolls 31, 32 increased 50% in comparison with the extrusion velocity, the heating elements having various characteristics were obtained. The characteristic curves of FIG. 6 were give by changing the stretching magnification ratios, the curve D is in 20% of magnification ratio, the curve C is in 30% of magnification ratio, the curve B is in 40% of magnification ratio and curve A is in 50% of magnification ratio, respectively.

Experiment

The planar heating element was applied for use as a floor heater of a pigsty in comparison with a known heater.

Three sheets of the planar heating elements of this invention with 20 cm width, 260 cm length, two sheets of them with 20 cm width, 240 cm length and one sheet of them with 20 cm width 200 cm length were used, respectively. A total calorific value of these elements was 740 W. A thermal proof mat of 1 cm thickness was spread on a basic concrete structure, then the planar heating elements were spread on the whole surface, and covered with concrete. As a comparative test, a planar heater made from linear heating element having the same total area and calorific value as the above mentioned heater according to this invention was used in the same way. Twelve pigs, each of which had 15 kg weight, were raised in the above two pigstys for 10 weeks respectively. During this period, electric current was applied to the heating elements for the whole days and the upper limit temperature was controlled to 30° C. A mean weight of the pigs raised in the pigsty using the planar heating element of this invention was 70 kg in 9 weeks, but the mean weight of the pigs raised in the pigsty using the known heater was only 65 kg.

Although the mean spent voltage of the planar heating element of this invention was 2.16 KW, the mean spent power of the known planar heating element was 4.04 KW, that is, heating efficiency of the planar heating element of this invention was quite excellent. In addition, the planar heating element can be spread on a wider area, for example 2 times or more, in comparison with the known planar heating element. Accordingly, with the planar heating element of this invention it is possible to keep the temperature of the pigsty more constant and this fact might result in the excellent growth of the pigs. In addition during that period, the spent amount of feed stuff of the pigs raised in the pigsty using the planar heating element of this invention was 10% by weight less than the other case.

Typical uses of the planar heating element of this invention are as follows.

In public works and architecture fields;

road heating, concrete including sheet, preventing pipe freezing, melting snow on a roof, floor heating, etc.

In chemical apparatus field;

heating and maintaining the temperature of a pipe, gas cylinder and tank, constant temperature vessel, etc. fermentation vessel In agriculture, forestry and stockbreeding field;

floor heating for pig raising, greenhouse, growing of various plants, etc.

In medical instrument field;

maintaining the temperature for blood transfusion, heater for bed, etc.

In household goods field;

preventing freezing for a water conduit, and heating mat for heating legs, a room, a water tank for tropical fish, etc.

What is claimed is:

1. A method for producing a planar heating element which comprises uniformly melt-admixing an insulating thermoplastic resin with an electrically conductive powder wherein said electrically conductive powder is present in an amount less than 40% by weight of the thermoplastic resin, extruding the mixture to form said planar heating element and immediately cooling the extruded heating element rapidly at a temperature of less than 20° C. whereby the conductive powder is in a higher concentration near the surface of the element.

2. The method for producing a planar heating element according to claim 1 in which the insulating thermoplastic resin is selected from the group consisting of polyethylene, poly-propylene, copolymer of ethylene and vinyl acetate, polyvinyl-chloride, polyamide and a mixture thereof.

3. The method for producing a planar heating element according to claim 1 in which the electrically conductive powder is carbon powder.

4. The method of claim 1 wherein the amount of the electrically conductive powder is 15% - 20% by weight of the thermoplastic resin.

5. The method of claim 1 wherein cooling said extruded heating element comprises passing said extruded body through a quenching liquid at 18° C at a rate of 2.5 m/min.

6. A method for producing a planar heating element which comprises uniformly melt-admixing an insulating thermoplastic resin with an electrically conductive powder wherein said electrically conductive powder is present in an amount less than 40% by weight of the thermoplastic resin, extruding the melted mixture to form said planar heating element, applying wires lengthwise into the extruded body, stretching or drafting the extruded body in the softening state and immediately continuously rapidly cooling the extruded body at a temperature of less than 20° C. whereby said electrically conductive powder is in a higher concentration near the surface of the element.

7. The method of claim 6. wherein said wires are applied to said extruded body by inserting said wires into said extruded body and then pressing said body into a sheet.

8. The method of claim 7 including subjecting said extruded body to high energy ionizing radiation.

* * * * *